United States Patent [19]

Wenkman et al.

[11] Patent Number: 5,038,935

[45] Date of Patent: Aug. 13, 1991

[54] STORAGE AND DISPLAY UNIT FOR PHOTOGRAPHIC PRINTS

[75] Inventors: Gregory J. Wenkman, Middleton; Ferdinand F. Salzmann, Prairie du Sac, both of Wis.

[73] Assignee: Uniek Plastics, Inc., Waunakee, Wis.

[21] Appl. No.: 482,463

[22] Filed: Feb. 21, 1990

[51] Int. Cl.[5] ..... B65D 85/48

[52] U.S. Cl. ..... 206/455; 206/449; 206/508; 40/156

[58] Field of Search ..... 206/39.3, 39.4, 39.5, 206/449, 556, 455, 472, 475, 508, 817, 815; 40/152, 156, 159.1

[56] References Cited

U.S. PATENT DOCUMENTS

| | | | |
|---|---|---|---|
| 1,537,641 | 5/1925 | Kristofek | 206/39.5 |
| 2,978,142 | 4/1961 | Novick | 206/508 |
| 3,117,692 | 1/1964 | Carpenter et al. | 206/508 |
| 3,205,601 | 9/1965 | Gawne et al. | 40/156 |
| 3,392,820 | 7/1968 | Azim | 206/455 |
| 3,419,184 | 12/1968 | Asenbauer | 206/508 |
| 4,170,914 | 10/1979 | Carrier | 206/39.5 |
| 4,261,124 | 4/1981 | Carter | 40/156 |
| 4,295,565 | 10/1981 | Takeuchi | 206/455 |
| 4,415,079 | 11/1983 | Ackeret | 206/455 |
| 4,467,919 | 8/1984 | Bengtsson et al. | 206/455 |
| 4,545,486 | 10/1985 | Bostic | 206/455 |
| 4,842,138 | 6/1989 | Sandel et al. | 206/370 |
| 4,877,213 | 10/1989 | Lambert | 40/156 |
| 4,937,959 | 7/1990 | Palmer et al. | 40/156 |

FOREIGN PATENT DOCUMENTS

| | | | |
|---|---|---|---|
| 291740 | 12/1931 | Italy | 206/455 |

*Primary Examiner*—David T. Fidei

*Attorney, Agent, or Firm*—Quarles & Brady

[57] ABSTRACT

A photographic print and storage unit includes a frame and a tray. A stack of photographs is held within the tray and against the frame by a set of stack lifting members activated when the frame and tray are closed. The stack lifting members include a cam plate that is compressed by the closing of the frame to lift a flexible finger against the bottom of the stack pressing the stack against the inner surface of the frame regardless of the number of pictures in the stack. An integral negative tray stores the negatives and a leg, detachably molded to the tray, may be used in conjunction with a series of mounting holes to provide support to the storage unit for tabletop display. The tray and frame are molded in one piece and attached by means of a living hinge of molded material.

22 Claims, 3 Drawing Sheets

STORAGE AND DISPLAY UNIT FOR PHOTOGRAPHIC PRINTS

BACKGROUND OF THE INVENTION

1. Field of the Invention

The field of the invention is storage and packaging units for photographic prints and in particular storage and packaging units that permit displaying of one or more stored prints.

2. Background Art

In the amateur photographic market, the processing of photographic film is typically performed by a commercial photographic laboratory. Such laboratories receive exposed film from their customers, which they develop to produce negatives. The negatives are then printed onto photographic paper to yield positive images "prints," and the prints and the negatives are returned to the customer. The negatives must be stored by the customer for use if additional prints are desired in the future.

The number of prints returned to the customer may vary depending on the number of "exposures" contained in the film roll. For the popular 35 mm. film size, 12, 24, or 36 exposure film rolls are commonly available. Often, badly underexposed or overexposed frames will not be printed by the processor to eliminate the waste of photographic paper, hence decreasing the number of prints returned to the customer to a number less than the number of initial exposures on the film roll.

The prints and negatives are most commonly retained to the customer in a paper envelope, which often includes a separate pocket for storing the negatives, to protect them from being scratched. Such paper envelopes are inexpensive, but provide relatively little protection to the prints when used for storage. Further, such envelopes provide no means of displaying the prints.

Some processing laboratories may offer their customers the option of having their prints bound in a miniature photographic album. The prints are thereby protected and may be stacked on a shelf like a book. Further, the binding system may be relatively inexpensive and hence offered as a promotion to encourage customers to use that particular processing laboratory. There are several drawbacks, however, to the use of an album in lieu of an ordinary envelope. From the point of view of the processing laboratory, the insertion of the prints into the album may add significant additional labor to the processing. Also the prints in the albums are not easily displayed, but must be removed for framing. Finally, the albums ordinarily do not have a provision for storing the negatives, and hence require the customer to store the negatives separately and create a means for cross-indexing the stored negatives to the prints.

Alternatively, the customer may purchase a film storage box. Typically the expense of such a storage box precludes its use as a substitute for the traditional envelope containing the prints and negatives and hence its use as a promotional item by the processing laboratory. Rather, such storage boxes must be sold separately to the customer through retail channels. Further, although some such storage boxes are clear and allow the topmost print to be seen through the box, they provide relatively little flexibility in displaying the prints, the clear plastic being used simply to aid in identifying the stored prints.

SUMMARY OF THE INVENTION

The present invention provides an inexpensive print storage and display means suitable for use by processing laboratories and the like for packaging processed negatives and prints. The storage unit may be injection molded in one piece thus reducing its cost and assembly expense.

The storage unit is comprised of a frame and a tray. The frame has a facing surface for covering the border of the top print in a stack of prints, which surface presses against the top print. The tray includes an area to receive the prints in. A hinge attaches the tray to the frame so that the frame may be closed around the stack of prints. The tray has side walls to restrain the stack against lateral movement when the tray is in the closed position. Stack lifting members, attached to the tray, apply a biasing force against the lower surface of the stack, when the storage unit is in the closed position, so as to compress the stack between the stack lifting members and the abutting surface of the frame.

It is one object of the invention to provide a means for both storing and displaying print photographs. The stack lifts press the stack against the rear face of the frame providing an attractive display of the topmost print regardless of the number of prints in the stack. By compressing the other prints in the stack, the stack lifts hold print stacks of different thickness neatly in place.

The tray includes a base, opposing the frame when the storage unit is in the closed position. The walls which guide the stack of prints into the tray when the storage unit is in the open position slope inwardly toward the base to align the stack when it is inserted into the tray. The base includes a finger hole to permit the removal of the stack by allowing the bottom of the stack to be pressed up when the tray and frame are in the open position.

Thus it is another object of the invention to provide a storage unit for photographic prints that does not require time consuming alignment and insertion of the prints. The stack lift is activated only when the tray is in the closed position, and hence does not interfere with the insertion of the prints into the tray.

The tray base also includes a recessed pocket for holding a plurality of negative strips associated with the print stack. Retaining tabs extend partially over the opening of the recessed pocket to hold the negatives within the pocket.

It is thus another object of the invention to provide a print storage means that provides a single package for returning both prints and negatives to a customer and that provides ready access to the negatives if duplicate prints are desired.

The lower surface of the tray base is shaped to match the upper facing surface of the frame to permit stacking of multiple storage units when in the closed position.

It is thus another object of the invention to permit the customer to store many sets of prints and to stack multiple storage units in a compact volume on a shelf or the like.

Side walls of the frame cover the side walls of the tray when the storage unit is in the closed position and extends outward at an obtuse angle from the facing wall so that the tray and frame will stack with other trays and frames when in the open position.

It is thus another object of the invention to permit the empty storage units to stack for efficient shipment to photographic processors.

The tray base includes at least one mounting flange having a mounting hole and a detachable leg for fitting into the mounting hole and projecting from the tray base to permit the tray to stand edgewise on a horizontal surface.

It is thus another object of the invention to permit the customer to have flexibility in displaying the topmost print of the stack. The storage unit may be set on a table or the like or attached to a wall by means of the mounting holes alone. In the latter case, the mounting leg remains attached and stored in the tray base.

Other objects and advantages besides those discussed above shall be apparent to those experienced in the art from the description of a preferred embodiment of the invention which follows. In the description, reference is made to the accompanying drawings, which form a part hereof, and which illustrate one example of the invention. Such example, however, is not exhaustive of the various alternative forms of the invention, and therefore reference is made to the claims which follow the description for determining the scope of the invention.

DETAILED DESCRIPTION OF THE PREFERRED EMBODIMENT

Figure 1:
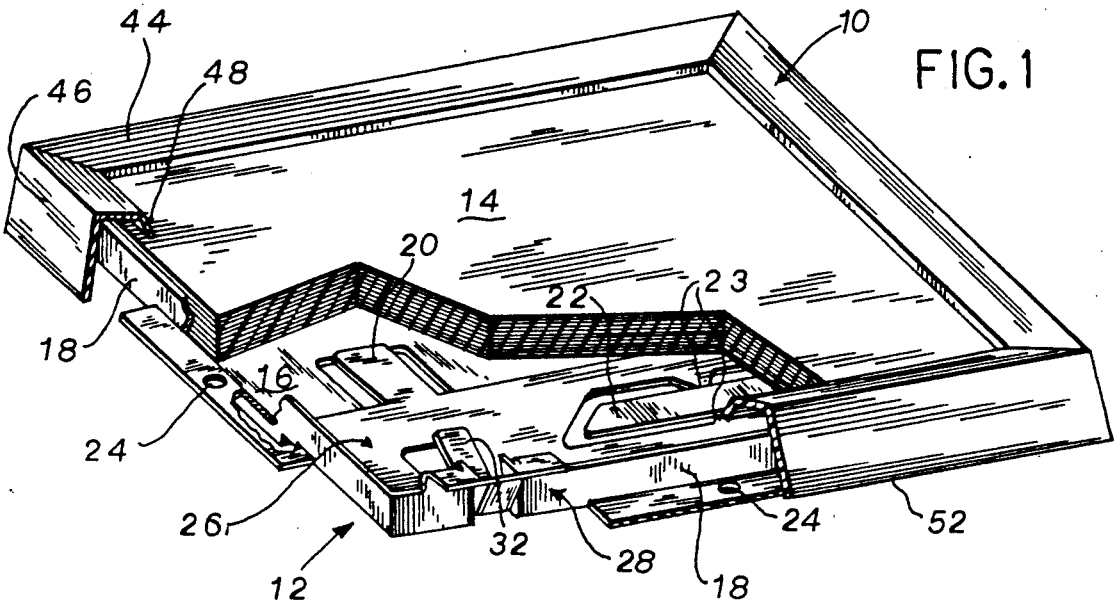
FIG. 1 is a perspective view of the storage unit of the present invention in the closed position with the stack of photographic prints cutaway to reveal the tray components.

In general, a photographic print storage and display unit constructed in accordance with the present invention includes a face frame section 10 and storage tray 12 integrally joined by a living hinge, and having a space between them sized and shaped to receive a stack of photographic prints 14, as is illustrated generally in Fig. 1.

Referring in detail to FIG. 1, the face frame section includes a generally rectangular print framing wall 44, which in turn has attached about its outer perimeter a downwardly extending side wall 46 forming a downwardly extending skirt around the entire exterior of the unit. Attached to the inner edge of the print framing wall is a print engaging wall 48, the latter extending downwardly to abut the upper surface of a stack of photographic prints 14. The stack of prints 14 is aligned beneath the frame 10 so that the picture surface of the topmost print is visible through the aperture formed by the frame 10, but so that its border is covered by the frame 10.

Figure 2:
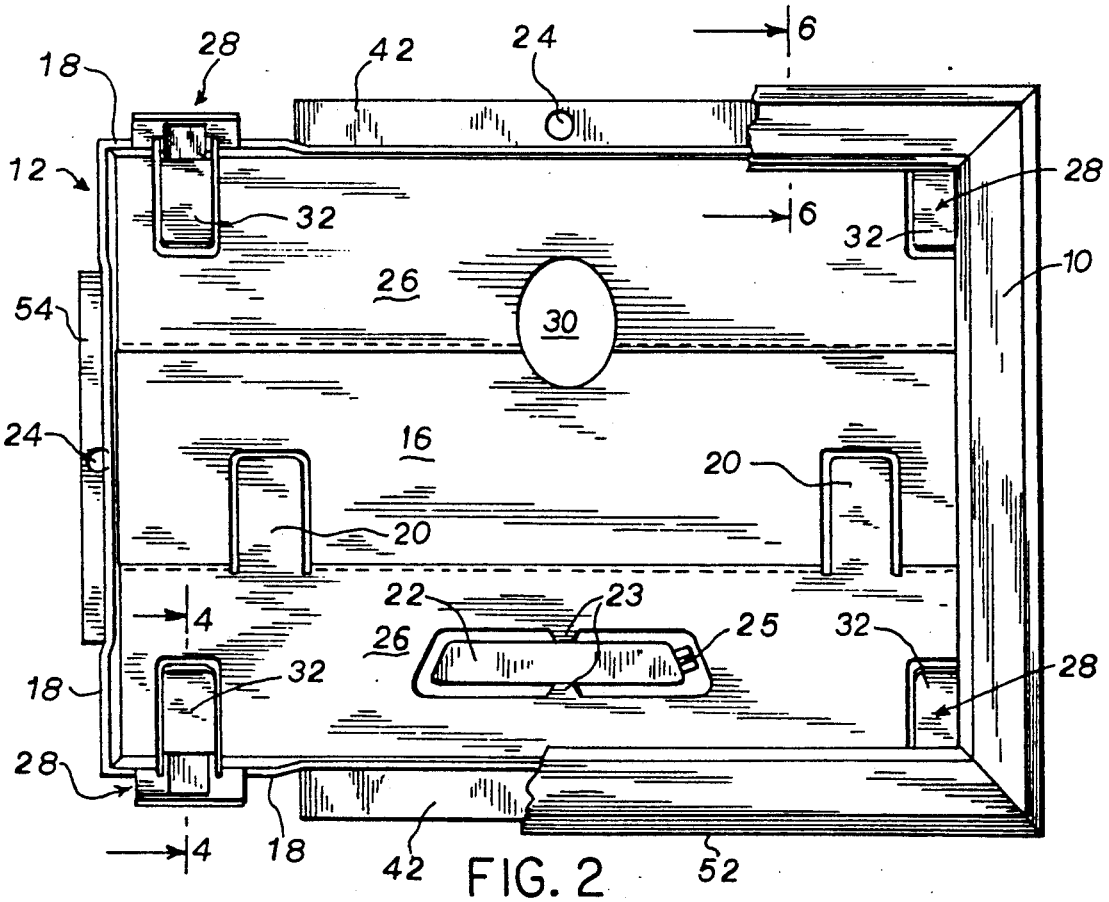
FIG. 2 is a plan view of the storage unit of the present invention with the a portion of the frame cut away to reveal the stack lifts.

Beneath the stack 14 and the frame 10 is the tray 12 which has a generally rectangular base 26 with vertically extending sidewalls 18 formed along its outer perimeter. The tray 12 and frame 10 are held together at one edge by a living hinge 52 and at an opposing edge by a catch, to be described below, so as to be opened and closed like a book, pivoting along the hinge. As viewed in FIG. 1, the tray 12 and frame 10 are in the "closed" position for storing and displaying the stack of prints 14. In the open position, the frame 10 swings away from the tray 12 like an opening book to reveal the stack 14 nestled in the tray 12. The vertically extending sidewalls 18 of the tray 12 surround the stack 14, in either open or closed position, and are canted outward as they rise away from the base 26 to readily receive the stack of prints 14. The canting of the sidewalls 18 allows the easy insertion of the prints 14 into the tray 12, even if each print in the stack 14 is not aligned perfectly with the others. As the stack 14 is inserted downwardly into the tray 12, the inward slope of the sidewalls 18 serves to collect and align each print with the others in the stack 14. Referring to FIG. 2, a finger hole 30 in the tray base 26 permits ready removal of the inserted stack 14 from the tray 12 by inserting a finger through the finger hole 30 and pressing upward against the lower surface of the stack 14.

Extending laterally and generally along the plane of the tray base 26, from each of four exterior sides of the base of the tray 12, are mounting flanges 42 and 54. The mounting flanges 42 are formed along the longer sides of the tray 12, while the mounting flanges 54 are formed along the shorter 15 sides of the tray 12. Each of the mounting flanges 42 or 54 has formed in it a mounting hole 24 which may be used to suspend the storage unit stably from a picture hanger on a wall in any one of four orientations, as is generally understood in the art. Alternatively, a support leg 22 may be press fit into any one of the mounting holes 24, to permit the storage unit to be set on any of its edges for table top display. Specifically, the support leg 22 is integrally molded as part of the tray base 26, and is held to the tray base 26 by holding sprues 23. The support leg 22 may be removed from the base 26 by twisting it about the axis formed by the holding sprues 23. A pin 25 formed on one end of the support leg 22 may then be inserted into any of the four mounting holes 24, so that the support leg 22 projects obliquely outward from the back of the tray 12 to provide a base, together with one face of the side wall 46 of the frame 10, to hold the storage unit upright for display on a horizontal surface. If not used, the support leg 22 may be left in place.

A laterally extending depression formed in the tray base 26 creates a negative storage pocket 16 for storage of the photographic negatives (not shown) associated with the prints in the stack 14. Retaining tabs 20 extend outward over the negative pocket 16, their upper surface flush with the plane of the tray base 26. The photographic negatives may be wrapped in a protective material, such as paper, and inserted into the negative pocket 16, beneath the retaining tabs 20, where the negatives are held compressed slightly between the lower surface of the retaining tabs 20 and the upper surface of the bottom of the negative pocket 16. Note that the finger hole 30 also extends partially into the bottom of the negative pocket to assist in removing the negatives from the unit.

Figure 3:
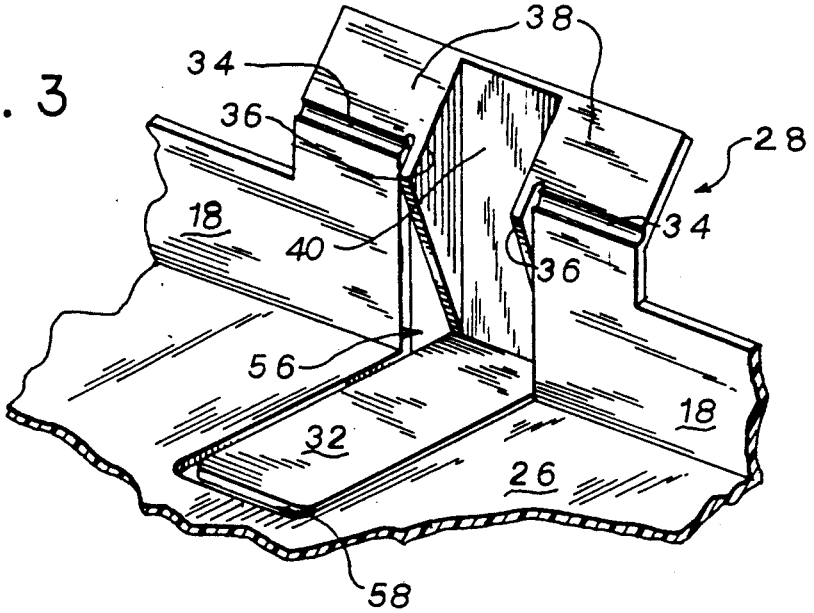
FIG. 3 is perspective view of one stack lift as shown in FIG. 1 and 2.

Positioned along the longer sides of the tray 12, near each of the four corners, are formed stack lifting members 28. The stack lifting members 28 are intended and designed to press upward on the bottom of the stack 14 when the frame 10 and tray 12 are in the closed position. Each of the stack lifting members 28 is a generally L-shaped member having one leg of its "L" shape being generally vertical and the other arm of the "L" forming a flexible lifting finger 32, as best seen in FIG. 3. The function of the stack lifting members 28 is to hold the stack 14 compressed between the upper surface of the flexible lifting fingers 32 and the lower edge of the print engaging wall 40 of frame 10. This pressure both prevents shifting of the stack 14 with respect to the frame 10 and tray 12 when the storage unit is in the closed position and also permits stacks 14 of varying thickness to be received in the unit with their top being engaged by the print engaging wall 48 of the frame 10, for proper display of the topmost print of the stack 14.

Referring again to FIG. 3, each stack lifting member 28 also includes a cam plate 38 attached at one edge to the upper edge of tray wall 18 by means of an "living hinge" 34. The living hinge 34 is formed from a thin section of the same material used to mold the other components of the the storage unit (polypropylene) and exhibits both flexibility along the hinge line between the cam plate 38 and the tray wall 18 and resilience which tends to restore the cam plate 38 to a specific hinge angle with respect to the tray wall 18 when no force is applied between the cam plate 38 and the vertical wall 18. This position will be termed the "relaxed" position.

Figure 4:
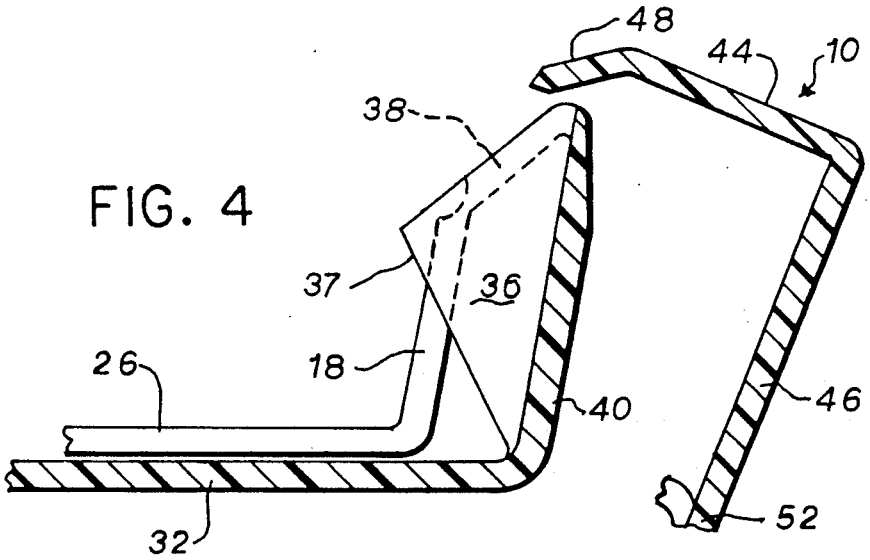
FIG. 4 is a sectional view taken in the plane indicated by lines 4—4 in FIG. 2 showing the stack lift uncompressed when the storage unit is in the open position.

Referring to FIGS. 3 and 4, the relaxed position of the cam plate 38 is initially such that the cam plate 38 extends outward and upward from the tray 12 and the tray wall 18 at approximately 45°. Extending downwardly from the cam plate 38, and affixed rigidly thereto by means of lifting member side braces 36, is a lever arm 40, which is the upper leg of the "L" of the stack lifting member 28. When the cam plate 38 is in the relaxed position, the lever arm 40 is essentially vertical or parallel to side wall 18. At its lower end, lever arm 40 is attached to the flexible lifting finger 32 which extends toward the tray 12 at approximately a right angle to the lever arm 40. When the cam plate 38 is in its relaxed position, the flexible lifting finger 32 is generally below and parallel to the tray base 26.

Figure 5:
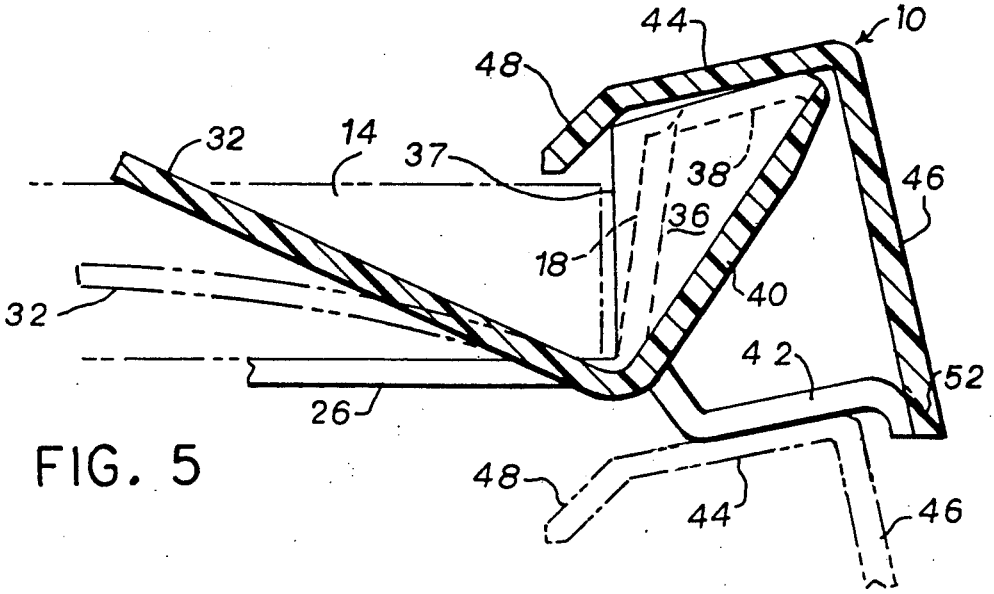
FIG. 5 is a sectional view similar to that of FIG. 4 showing the stack lift compressed when the storage unit is in the closed position.

Referring now to FIGS. 3 and 5, when the storage unit is closed, the lower surface of the facing wall of the frame 10 contacts the upper edge of the cam plate 38, rotating the cam plate 38 about the hinge 34 until the cam plate 38 extends more nearly perpendicularly out from the side wall 18. The effect of this compression is that the lever arm 40 rotates clockwise as viewed in FIG. 5, swinging in to the tray 12 through an aperture 56 in the side wall 18. The flexible lifting finger 32 rises simultaneously through an aperture 58 in the tray base 26 to press against the lower surface of the stack 14 positioned above it. The rising flexible lifting finger 32 resiliently forces the stack 14 upward against the lower edge of print engaging wall 48 of frame 10. The flexible lifting finger 32 is specifically formed of narrow cross section (approximately 0.040") material so as to flex downward with resistance of the stack 14 to upward motion. This flexing serves to equalize the pressure on stacks of varying thickness and permit the storage unit to accommodate stacks 14 of different sizes. As will be apparent from this description, the biasing force of the stack lifting members 28 on the stack 14 occurs only when the frame 10 and tray 12 are in the closed position. Hence, when the frame 10 and tray 12 are in the open position, the stack 14 may be inserted into the tray 12 without interference from the stack lifting members 28.

Another function of the stack lifting members can be best seen in FIG. 5. Note that the lifting member side braces 36 have a linear front print aligning edge 37. When the cam plate 38 is not compressed by the frame 10, the print aligning edge 37 of the lifting member side brace 36 is slanted back from vertical with its downward edge out, as can be seen in FIG. 4. When the frame is placed on the tray, as viewed in FIG. 5, the side brace 36 is pivoted forward with the rest of the lifting member and the print aligning edge 37 moves to a more approximately vertical orientation. This vertical orientation of the print aligning edge 37 engages the edge of the photographic prints so as to align or reshuffle the prints into a neat stack in the tray 12. Thus at the same time that the lifting fingers 32 are pressing against the back of the prints to lift them, the print aligning edges are engaging the edges of the prints to align the stack of prints into an even stack for neat storage. This same alignment serves to center the topmost print in the center of the frame so that it is better framed for display.

Referring again to FIG. 5, the frame 10 is attached to the tray 12 by means of the living hinge 52 which extends between one of the mounting flanges 42 and one edge of the side wall 46 of the frame 10. This living hinge 52 is formed of a thin section of polypropylene between integrally molded frame 10 and tray 12.

Figure 6:
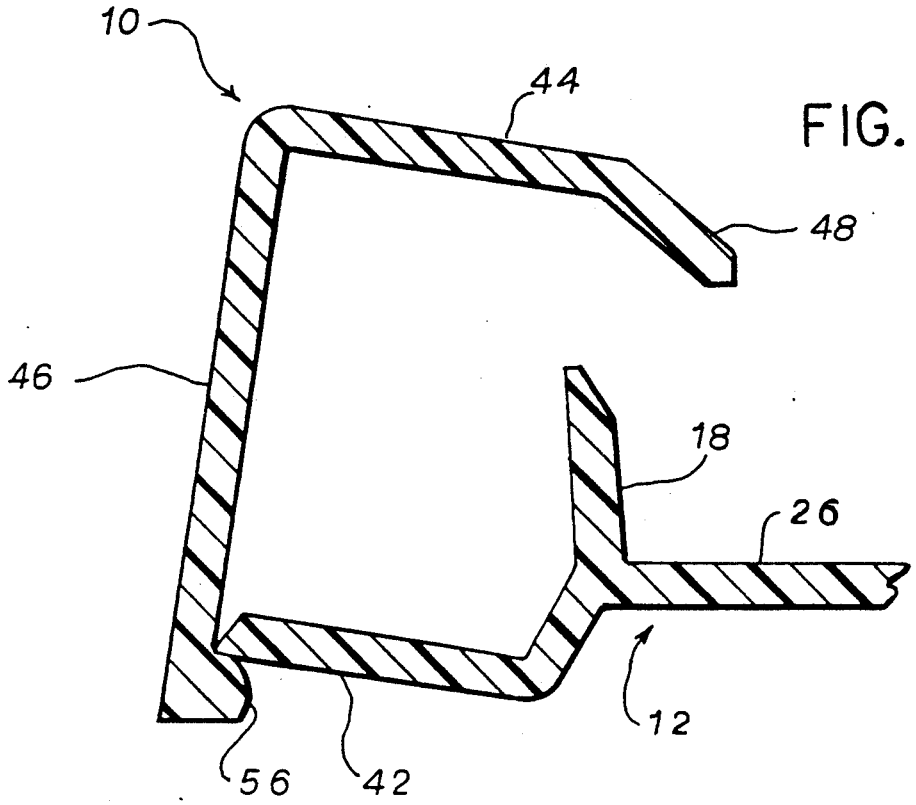
FIG. 6 is a sectional view taken in the plane indicated by lines 6—6 in FIG. 2 showing the catch for securing the frame of the storage unit of FIG. 1 to the tray.

Referring to FIG. 6, it can be seen that the side wall 46 of the frame 10 opposite from the living hinge 52 has an inwardly extending lip 50 along its lower edge which serves to catch the lower edge of the mounting flange 42 of the tray 12 opposing the hinge 52. Thus the storage unit is closed by folding the living hinge 52 so that the frame 10 covers the tray 12, and flexing side wall 40 outward to allow passage of the lip 50 past the mounting flange 42, to engage the lower surface of the mounting flange 42. The relaxed position of the living hinge 52 is in the open position and hence the upper edge of the lip 50 is held positively against the lower edge of the mounting flange 42 when the storage unit is empty. When a stack of prints 14 is in the storage unit, the restoring force of the living hinge 52 is combined with the upward pressure of the stack 14 on the frame 10, resulting from the stack lifting members 28, to hold the snap closure of the lip 50 on the mounting flange 42 in place.

Figure 7:
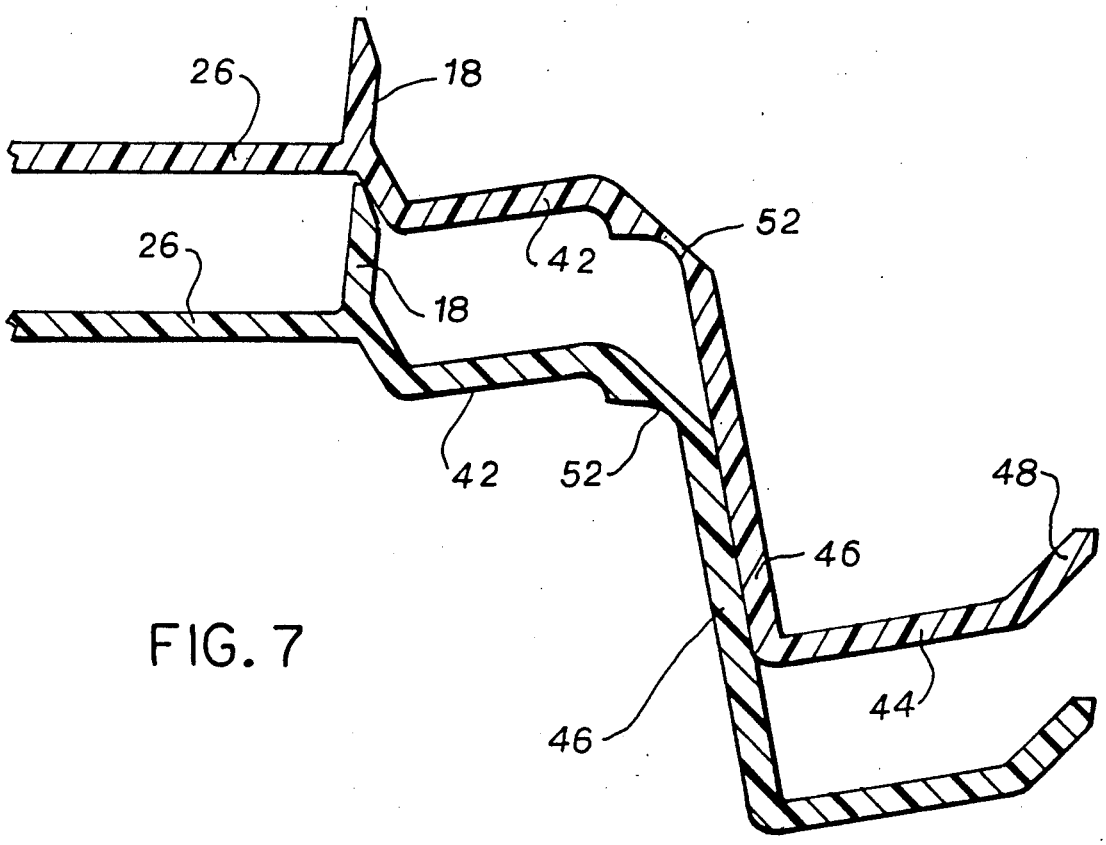
FIG. 7 is a sectional view taken in the plane similar to that of FIG. 4 showing several storage units stacked in the open position.

Referring to FIG. 7, the empty storage units in the open positioning may be stacked in a nesting fashion by fitting the upper edge of the vertical tray walls 18 against the bottom of the base 26 of the next higher tray 12 and nesting the attached, but open, frames 10 within each other. The nesting of the frames 10 is facilitated by the slight relief of the side walls 46 away from the facing wall 44.

Note that when the stack of prints 14 is in the unit, the image of the topmost photographic print is clearly visible and is framed by the frame 10. This framing effect occurs regardless of the number of prints in the unit. Since the lifting members 28 act to lift the prints in the unit, the prints are always held securely and the topmost print is always framed. This design thus permits a relatively economical photographic print and storage unit to be manufactured such that the unit could be distributed to consumers with their photographic prints by the photo finisher. In spite of its economical design, the unit serves as an efficient storage device and display device even over a large range in the number of prints in the unit.

The above description has been that of a preferred embodiment of the present invention. It will occur to those who practice the art that many modifications may be made without departing from the spirit and scope of the invention. For example, a clear protective sheet may be used to cover the topmost print of the stack 14 to protect the topmost print from dust and from the pressure of the lower edge of the print engaging wall 48. Also, a magnet may be added to the rear surface of the unit to facilitate mounting the unit as a photographic display on a metal surface. In order to apprise the public of the various embodiments that may fall within the scope of the invention, the following claims are made.

We claim:

1. A photographic print storage unit for storing and displaying a stack of photographic prints comprising:

a tray for receiving the stack and having side walls for guiding and restraining the stack against lateral movement;

a face frame section pivotable between an open and a closed position such that in the closed position the face frame fits over the tray and covering the border of the top surface of the stack, the face frame having a print engaging wall for abutting the upper surface of the top of the stack, and in the open position the face frame uncovering the tray to permit the tray to receive the stack; and stack lifting member attached to the tray for applying an upward biasing force against the lower surface of the stack when the storage unit is in the closed position, so as to compress the stack between the stack lifting member and the print engaging wall of the frame;

and wherein the stack lifting member is pivotable relative to the tray and arranged to be pivoted by the face frame section to provide an upward biasing force against the stack only when the face frame section is in the closed position and not when the face frame section is in the open position.

2. The storage unit of claim 1 wherein the sidewalls slope inwardly toward the base of the tray to align the stack when it is inserted into the tray.

3. The storage unit of claim 2 wherein the tray base includes a finger hole to permit the removal of the stack by permitting the bottom of the stack to be pressed up when face frame section is in the open position.

4. The storage unit of claim 2 wherein the tray base includes a recessed pocket having an opening on one side through which to receive a plurality of negative strips associated with the stack.

5. The storage unit of claim 4 wherein retaining tabs extend partially over the opening of the recessed pocket to hold the negatives within the pocket.

6. The storage unit of claim 4 wherein the lower surface of the tray base is shaped to match the upper facing surface of the frame to permit stacking of multiple storage units when in the closed position.

7. The storage unit of claim 1 wherein the face frame section has a side wall extending back from the face frame section to surround the side walls of the tray when the tray and frame are in the closed position and wherein the side wall extends outward at an obtuse angle from the facing wall so that the tray and frame will stack with other trays and frames when in the open position.

8. The storage unit of claim 1 wherein there is a hinge joining the tray and the face frame section.

9. The storage unit of claim 8 wherein the tray, the face frame section, and the hinge are all injection molded as one piece.

10. A photographic print storage unit for storing and displaying a stack of photographic prints comprising:

a tray for receiving the stack and having side walls for guiding and restraining the stack against lateral movement;

a face frame section for covering the border of the top surface of the stack and having a print engaging wall for abutting the upper surface of the top of the stack, the face frame section sized and shaped to fit over the tray and movable between an open and a closed position; and stack lifting members attached to the tray for applying an upward biasing force against the lower surface of the stack when the face frame section is in the closed position, so as to compress the stack between the stack lifting members and the print engaging walls of the face frame section, the stack lifting members being pivotable relative to the tray and arranged to be in a resiliently biased upward position only when the face frame section is closed on the tray, the stack lifting members being cammed into their resilient upward biasing position by the face frame section engaging a camming surface attached to the stack lifting member when the face frame section is in the closed position.

11. A photographic print storage unit for storing and displaying a stack of photographic prints comprising:

a tray for receiving the stack and having side wall for guiding and restraining the stack against lateral movement;

a face frame section for covering the border of the top surface of the stack and having a print engaging wall for abutting the upper surface of the top of the stack, the face frame section sized and shaped to fit over the tray and pivoting between an open and a closed position;

stack lifting members attached to the tray for applying a upward biasing force against the lower surface of the stack when the face frame section is in the closed position, so as to compress the stack between the stack lifting members and the print engaging walls of the face frame section, the stack lifting members being pivotable relative to the tray and arranged to be resiliently biased upward only when the face frame section is closed on the tray; and the tray base including at least one mounting flange having a mounting hole and wherein the tray base includes a detachable leg for fitting into the mounting hole and projecting from the tray base to permit the tray top stand edgewise on a horizontal surface.

12. A photographic print storage unit for storing a stack of planar photographic prints and displaying the topmost print comprising:

a tray for receiving the stack and having side walls for guiding and restraining the stack against lateral movement in the tray;

a frame section movable between an open position and a closed position and sized and shaped so that in the closed position the frame section fits over the tray covering the border of the top surface of the stack having a print engaging wall abutting the upper surface of the top of the stack, and in the open position permitting the tray to receive the stack;

a hinge joining the frame section to the tray;

a plurality of stacking lifting members in the tray each having;

a flexible lifting finger for applying upward biasing force against the lower surface of the bottom-most print in the stack so as to compress the stack between the stack lifting member and the print engaging surface of the frame section;

a lever arm attached to the flexible finger to bias the flexible finger when the lever arms is rotated; and a cam plate for riding against the lower facing surface of the frame section and attached to the lever arm for rotating the lever arm when the frame section is in the closed position.

13. The storage unit of claim 12 wherein the sidewalls slope inwardly toward the base of the tray to align the stack when it is inserted into the tray.

14. The storage unit of claim 13 wherein the tray base includes a finger hole to permit the removal of the stack by permitting the bottom of the stack to be pressed up when the tray and frame are in the open position.

15. The storage unit of claim 13 wherein the tray base includes a recessed pocket having an opening on one side through which to receive a plurality of negative strips associated with the stack.

16. The storage unit of claim 15 wherein retaining tabs extend partially over the opening of the recessed pocket to hold the negatives within the pocket.

17. The storage unit of claim 15 wherein the lower surface of the tray base is shaped to match the upper facing surface of the frame to permit stacking of multiple storage units when in the closed position.

18. The storage unit of claim 12 wherein the face frame section has a side wall extending back from the face frame section to surround the side walls of the tray when the tray and frame are in the closed position and wherein the side wall extends outward at an obtuse angle from the facing wall so that the tray and frame will stack with other trays and frames when in the open position.

19. The storage unit of claim 12 wherein the tray and the face frame section are injection molded as one piece.

20. The storage unit of claim 19 wherein the hinge is a living hinge integrally injected molded with the tray and the face frame section.

21. The storage unit of claim 20 wherein the tray base includes at least one mounting flange having a mounting hole and wherein the tray base includes a detachable leg for fitting into the mounting hole and projecting from the tray base permit the tray to stand edgewise on a horizontal surface.

22. The storage unit of claim 12 wherein the stack lifting members further include side brace members extending between the lever arms and the lifting fingers, the from edge of the side brace members serving as a print aligning edge to align the edges of the prints in the tray as the lifting member is rotated.

* * * * *